United States Patent [19]

Hackett

[11] Patent Number: 4,885,568

[45] Date of Patent: Dec. 5, 1989

[54] INTEGRATED ALARM TRANSPONDER

[75] Inventor: Kenneth R. Hackett, Boulder, Colo.

[73] Assignee: Interactive Technologies, Inc., North St. Paul, Minn.

[21] Appl. No.: 273,927

[22] Filed: Nov. 21, 1988

[51] Int. Cl.[4] ..... G08B 26/00

[52] U.S. Cl. ..... 340/518; 340/505; 340/536; 340/825.08; 340/825.1; 340/825.14; 340/825.2; 340/870.13

[58] Field of Search ..... 340/518, 531, 505, 506, 340/536, 829.54, 825.06–825.13, 825.14, 525, 825.2, 870.13, 870.14; 370/77, 90, 96, 91

[56] References Cited

U.S. PATENT DOCUMENTS

| | | | |
|---|---|---|---|
| 4,228,424 | 10/1980 | LeNay et al. | 340/518 |
| 4,465,904 | 8/1984 | Gottsegen et al. | 340/518 |
| 4,586,040 | 4/1986 | Akiba et al. | 340/518 |
| 4,680,582 | 7/1987 | Mejia | 340/518 |
| 4,742,335 | 5/1988 | Vogt | 340/518 |
| 4,754,262 | 6/1988 | Hackett et al. | 340/505 |

*Primary Examiner*—Donnie L. Crosland
*Attorney, Agent, or Firm*—Douglas L. Tschida

[57] ABSTRACT

A time multiplexed integrated alarm contact for reporting detected alarm conditions to a system controller in a hardwired alarm system and wherein distinguishable binary frequencies are used for synchronizing/responding and for programming the contact. During programming, an identity code is written into an included shift register and non-volatile memory defining the system reporting interval and the contact's reporting interval within the system interval. Controller initiated synchronizing signals induce each contact's status transmission with or without resetting an alarm buffer and whereby redundant alarm reports may be obtained.

11 Claims, 13 Drawing Sheets

3e10
PROGRAM. CONTROL
3i4
3i5
3i6
3i7
3i8
3i9
3i10
3i11
3i12
3i13
3i1
3i2
3e9
3e8
3e7
3e6
3e5
3e4
3e3
3e2
3e1
TM15
TM14
TM13
TM12
TM11
PC13
PC14
52
TC11
SP1
SC2
PC1
PC2
PC3
PC6
PC5
PC4
PROGRAMMING FREQUENCY DETECT 44

3g2
3i3
PC10
PC9
PC8
50
3g5
COUNTER 22
PULSE GENERATOR 3
AP1
3g6
PROGRAM QUALIFICATION TIMER
3g1
3g10
+VDD
1D10
3g9
3g4
3g3
3f4
3g7
3g8

INTEGRATED ALARM TRANSPONDER

BACKGROUND OF THE INVENTION

The present invention relates to hardwired security systems and, in particular, to an integrated, time multiplexed, programmable alarm contact. Distinguishable binary programming and synchronizing/responding frequencies establish a unique alarm reporting interval and permit singular or redundant alarm status reports during successive reporting intervals.

The present invention relates to Applicant's pending U.S. Pat. No. 4,754,262 which discloses a time multiplexed security alarm system including a discrete microcomputer which is separately mounted in the vicinity of a plurality of distributed transponders and switch contacts. Each of the transponders have an assigned identity or reporting period relative to the reporting cycle of the micro-computer 10. Operating power for each transponder is derived from the hardwired transmission line coupling the transponders to the microcomputer 10.

The foregoing system also operates relative to narrow band tone signaling wherein a micro-computer directed synchronizing frequency, different from that of a transponder alarm frequency, induces transponder status transmissions. Each transponder's assigned transmission time is programmable by way of hardwired jumpers which require physical intervention by the installer. Also disclosed is a scheme including a counter for redundantly reporting contact openings.

A discussion of the operation of a related multiplexed module monitoring a plurality of input switches, wherein each switch has an assigned identity, in a micro-processor controlled security system may also be found upon directing attention to the present Assignee's copending U.S. Pat. application, Ser. No. 07/156,547 entitled "Micro-Programmable Security System."

Although the foregoing transponders and module provide numerous advantages to security system installers, heretofore the circuitry of each transponder has been separately mounted from the contact being monitored. It is preferable in many instances, however, that all of the associated transponder circuitry be integrated into a single package, along with the transponder switch typically a magnetically operated reed switch.

Such a package preferably should be small enough to be mounted in undetectable relation to the physical environmental condition being monitored. For example, the package should mount within a door or window frame and be obstructed by the monitored door or window, when in its normally aimed condition. Preferably, too, the circuit organization of such an assembly should permit performance of multiple and/or overlapped functions. Moreover, the transceiver circuitry should be responsive to a plurality of frequencies to permit improved system functionality.

SUMMARY OF THE INVENTION

The subject invention accordingly provides for an improved alarm transponder wherein an alarm contact is integrated with hardwired transceiver circuitry into a single package for tonally reporting alarm status in a time multiplexed hardwired system. Alarm status conditions are reportable, either singularly or in a redundant fashion.

It is accordingly one object of the invention to provide for distinguishable binary frequencies for synchronizing transponder reporting and for programming the circuitry.

It is another object of the invention to provide for a non-volatile memory for storing each transponder's identity code (i.e. the delay before its reporting interval), whereby re-programming is not required.

Is is a further object of the invention to provide switched circuitry wherein various circuit components may perform alternative functions relative to the programming and synchronizing/responding modes of operation.

Various of the above objects and advantages of the present invention are achieved in a multi-mode circuit organization including means for distinguishing a pair of binary programming frequencies from a pair of system controller induced synchronizing frequencies and writing an associated shift register and non-volatile memory. During a synchronizing/responding mode, the second pair of frequencies synchronize each transponder to the system controller, initiate an alarm or status scan and appropriately couple the transponder's alarm switch condition to a transmit signal generator. Depending upon the scan or alarm report initiating frequency, the alarm condition may be reported once or a successive number of times.

The foregoing objects, advantages and distinctions of the invention, among others, will become more apparent hereinafter upon reference to the following detailed description with respect to the appended drawings. Before referring thereto, it is to be appreciated the following description is made by way of the presently preferred embodiment of the invention only, which description should not be interpreted in limitation of the spirit and scope of invention claimed hereinafter. To the extent modifications or other alternative embodiments may have been considered, they are described as appropriate.

DESCRIPTION

FIG. 1 shows a schematic diagram of the present integrated transponder relative to a typical alarm system.

FIGS. 2*a* and 2*b* show a block diagram of the integrated circuitry of the presently improved transponder.

FIGS. 3 and 3*a* through 3*i* show a detailed schematic diagram of the circuitry of FIG. 2.

DESCRIPTION OF THE PREFERRED EMBODIMENT

Figure 1:
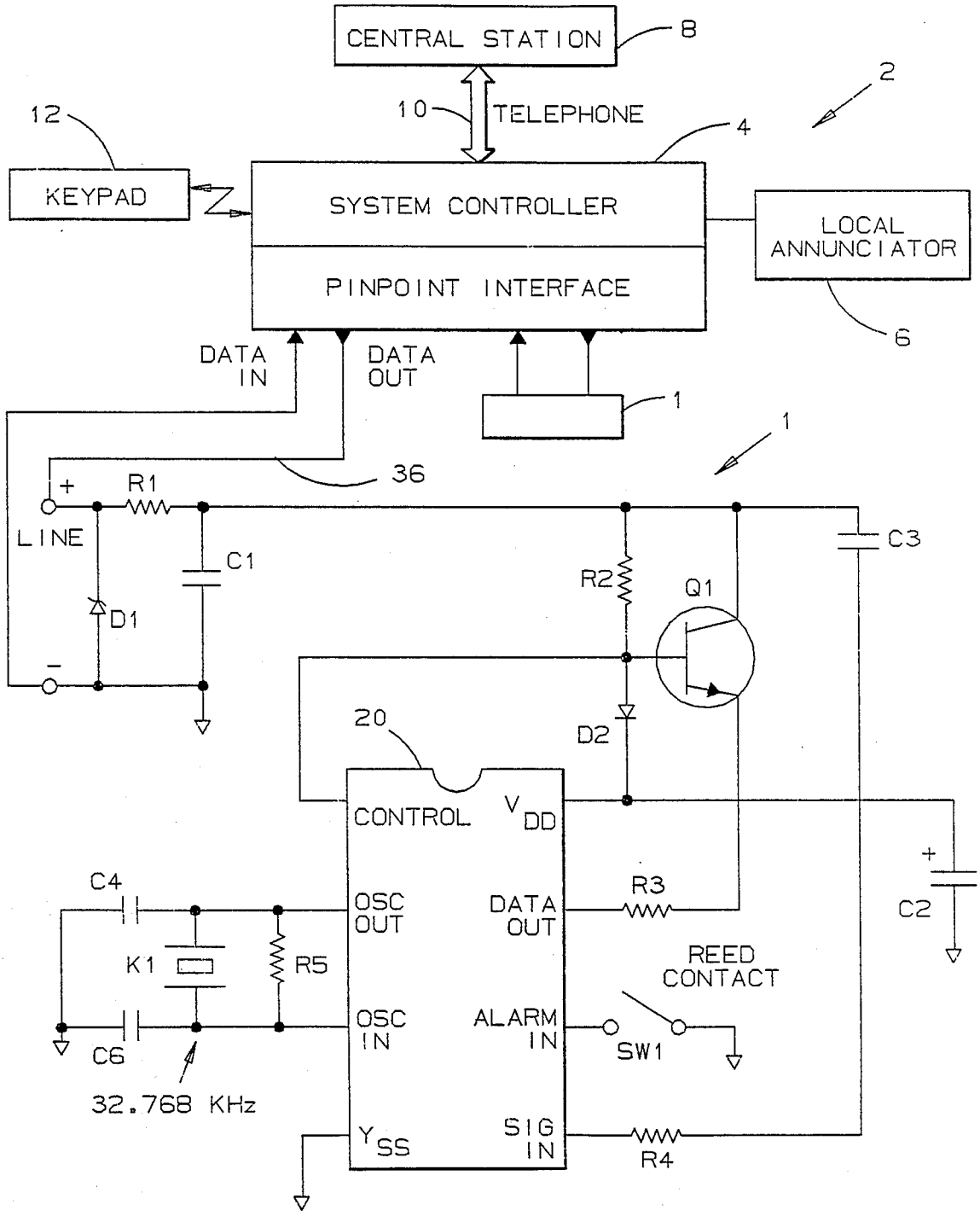

Referring to FIG. 1, a generalized system diagram is shown of the programmable or intelligent transponder contact 1 of a present invention relative to its coupling to a typical alarm security system 2. In such a system 2, a system controller 4 is typically operated under microprocessor control to responsively monitor a number of distributed hardwired and wireless alarm switch contacts at doors/windows. As appropriate, a variety of other environmental alarms, such as motion detectors, floormat sensors, fire/smoke detectors, temperature sensors, etc. may also be monitored.

Depending upon the system organization, the system controller 4 may respond to detected alarms by appropriately producing local annunciations via a variety of local annunciators generally referenced by a call out numeral 6. These may comprise horns, lights, buzzers etc. Additionally, the system controller 8 may communicate with a central station 8 via a single or multi-lined telephone link 10 coupling one to the other.

Depending upon the system, the system controller's 4 response may in part be predetermined, although can be modified by the user or installer via an associated key pad 12 which may be coupled in a wireless fashion as shown or be hardwired to the controller 4. Various of these other couplings can be seen in the present Assignee's co-pending U.S. patent application No. 07/156,547.

Otherwise and as to the present invention, the system controller 4 of Applicant's system includes a so called Pinpoint TM interface. That is, circuitry is included in the controller cabinetry for monitoring and controlling system controller 4 communications with a plurality of hardwired transducer inputs. Although only one integrated transponder 1 of the present invention is shown in detail, it is to be appreciated a number of transponders or serial or serial/parallel coupled loops (not shown) might be coupled to the Pinpoint TM interface. Each of such loops may include one or more of the intelligent transponders 1, along with other transducers. Thus, depending upon the loop configuration, the coupled transducers/transponders may be variously identifiable, either singularly or as a group. Others of such configurations are disclosed in Applicant's U.S. patent and the present Assignee's co-pending application Ser. No. 07/156,547.

The transponder of the subject invention is particularly shown in a general schematic diagram in the lower portion of FIG. 1. This circuitry is typically configured in a package approximately one-half inch in diameter and 2 inches long which can be inserted in a mating drilled hole in a window or door frame. A magnetic reed switch SW1 mounts at the outer end of the package with a mating magnet being secured to the adjacent frame member. Upon door or window closure, the magnet induces switch closure or an armed condition. A subsequently detected open switch condition is thus interpreted as an alarm.

As presently configured, all of the control circuitry of the transceiver is contained in the integrated circuit 20 with the reed contact SW1, crystal oscillator K1, transistor driver Q1 and associated filter circuitry (D1, R1, C1) being mounted external to the circuit 20. Operating power is also derived from the line in lieu of an external battery. This again permits packaging the entire assembly in a rather small package. In passing, it is also to be appreciated that the circuit 20 is constructed in an 8 pin DIP arrangement which in its present construction provides for a nominal plus four volt input port VDD, a ground port VSS, a pair of oscillator input/output pins, an alarm input, a sync/programming signal input and a data output port.

Figure 2A:
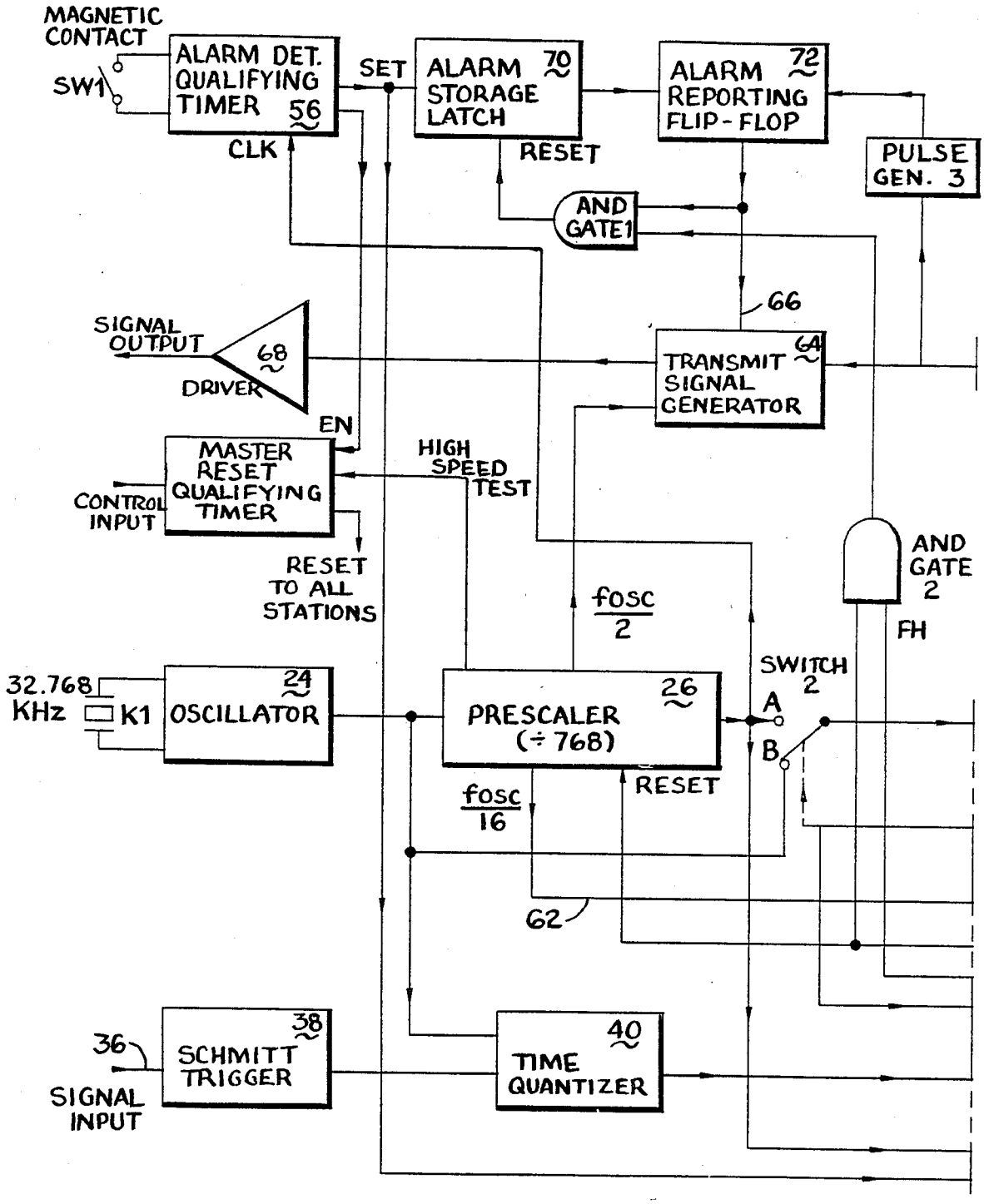
Figure 2B:
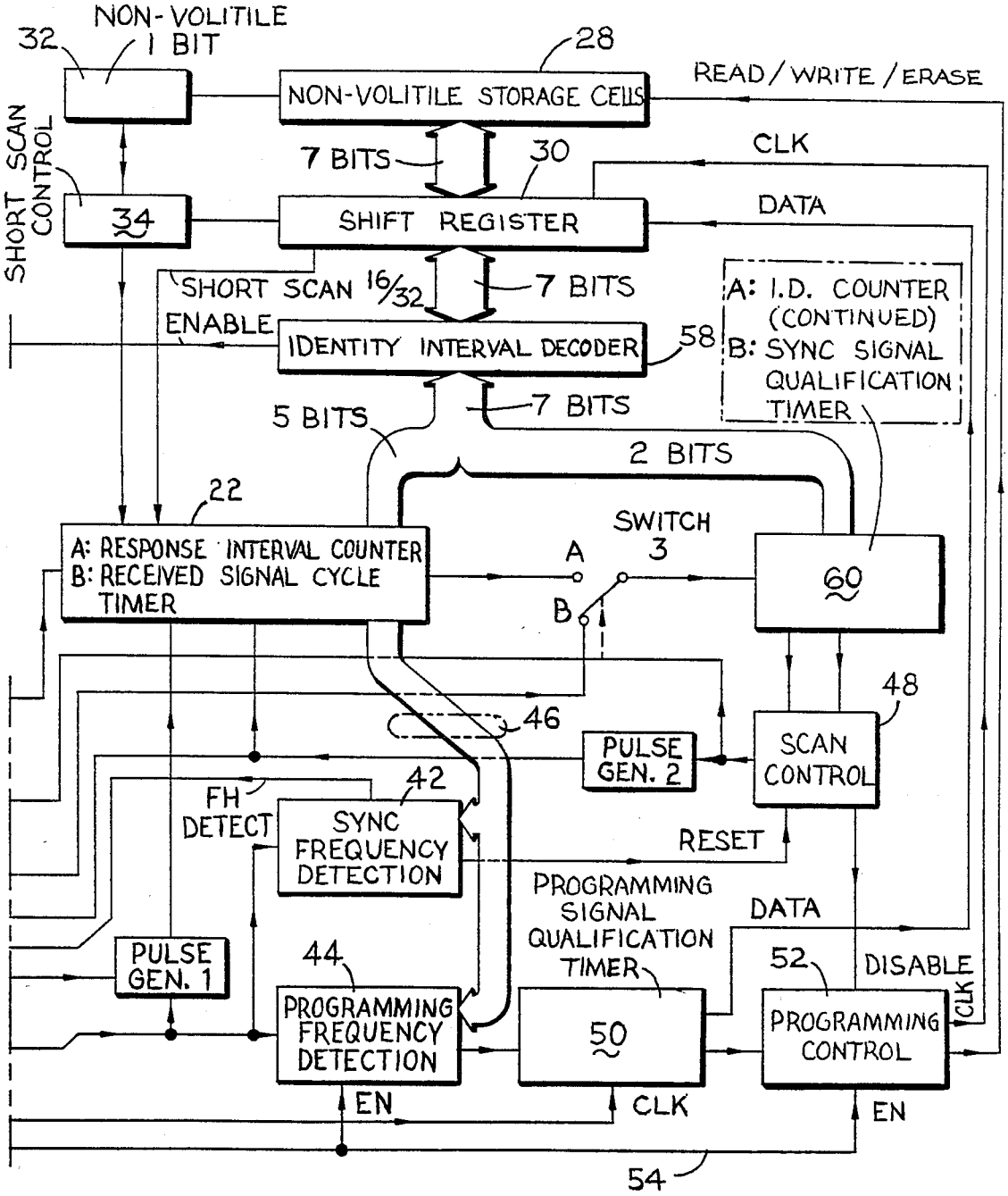
Figure 3:
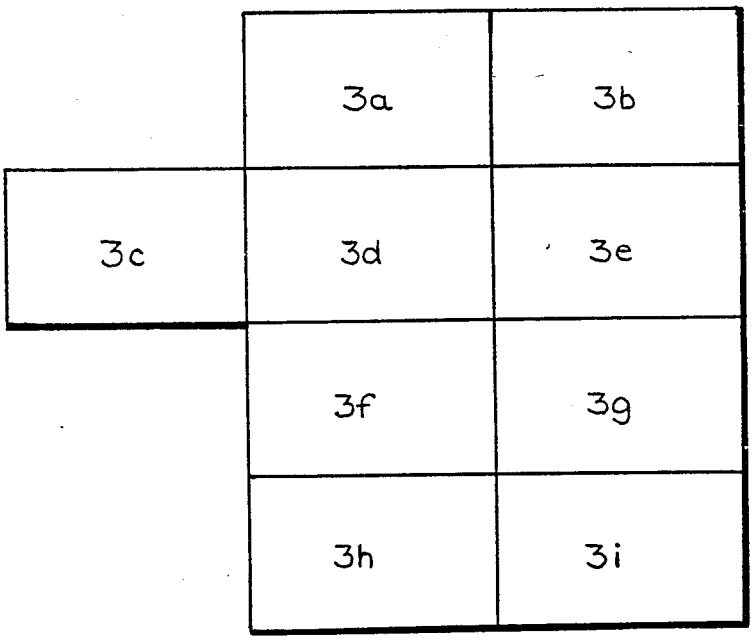
Figure 3A:
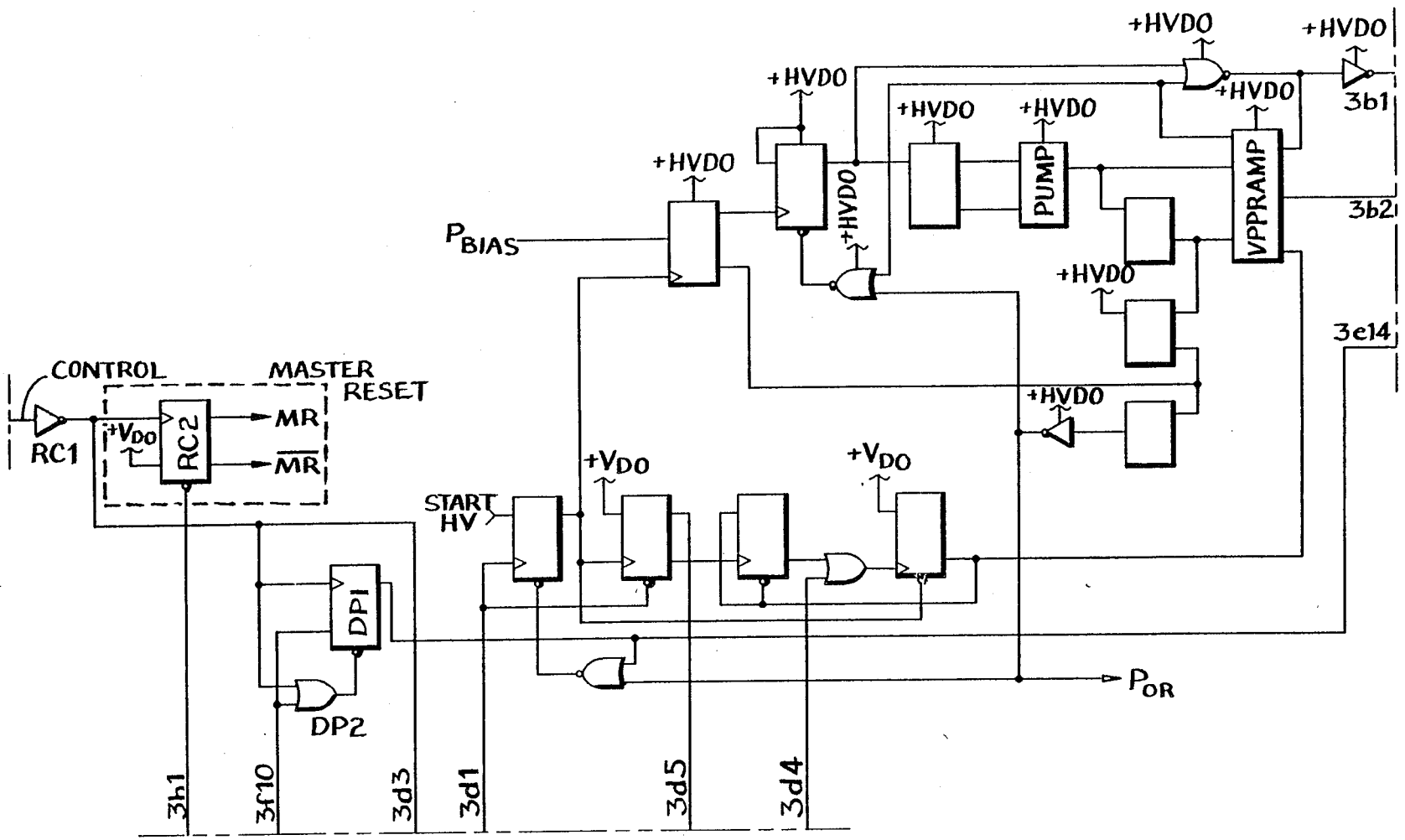
Figure 3B:
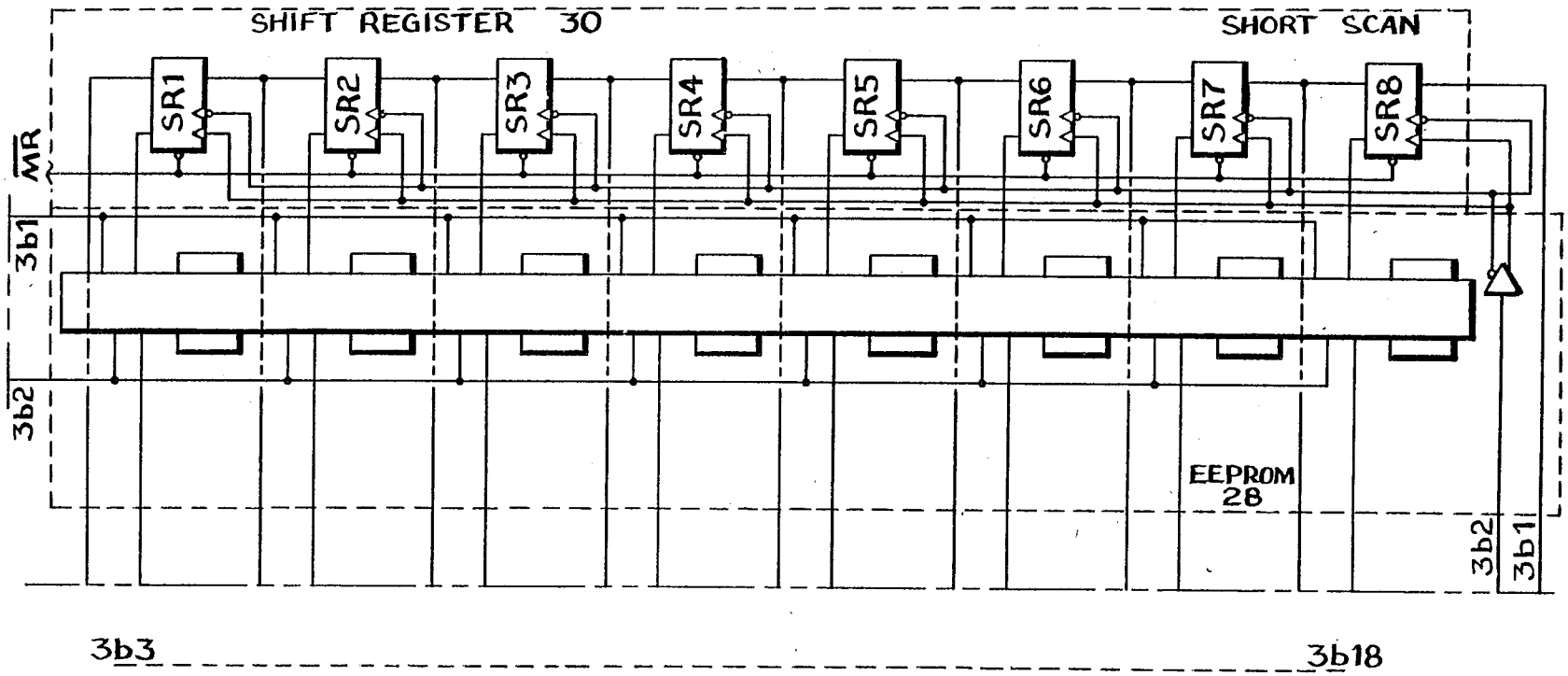
Figure 3C:
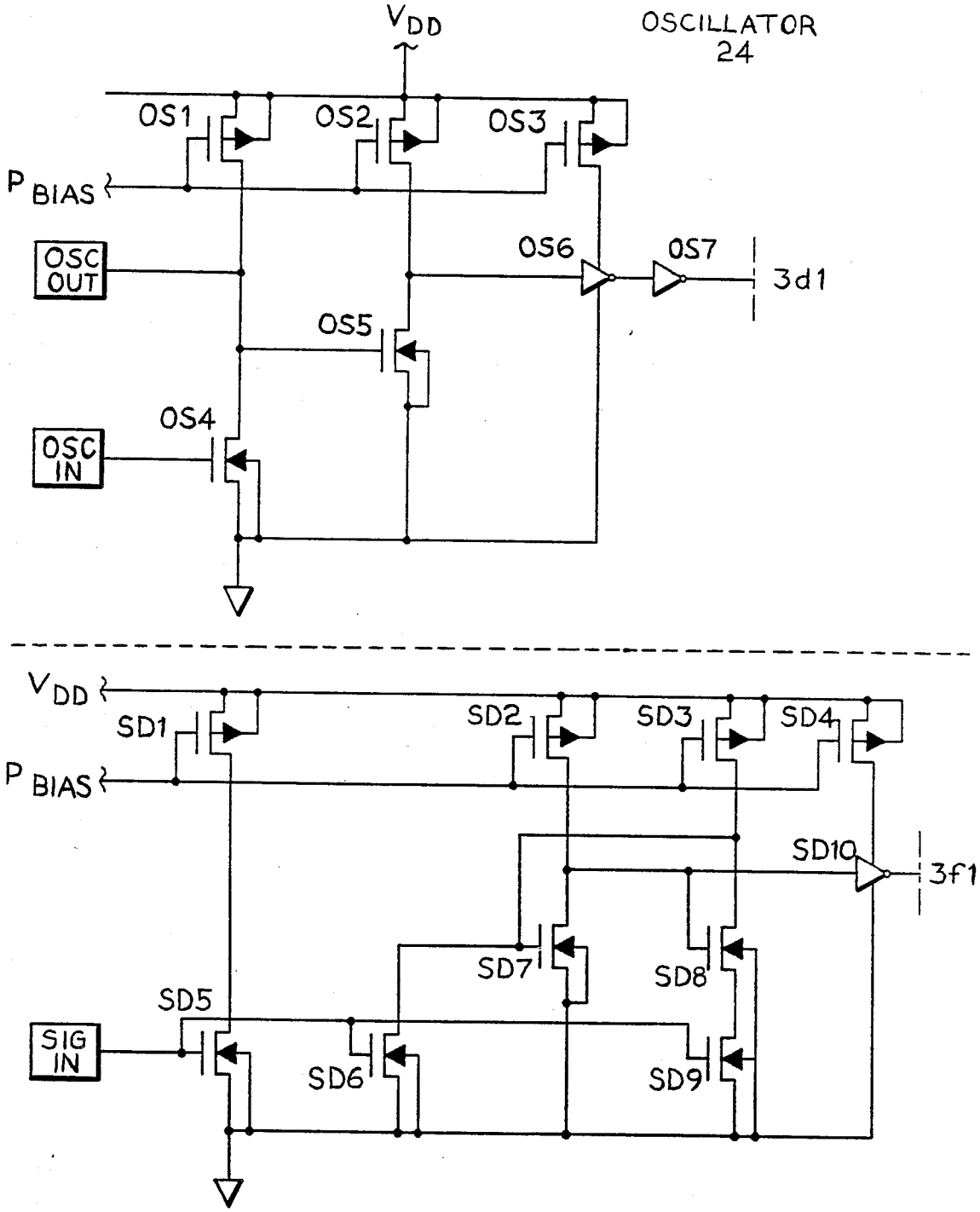
Figure 3D:
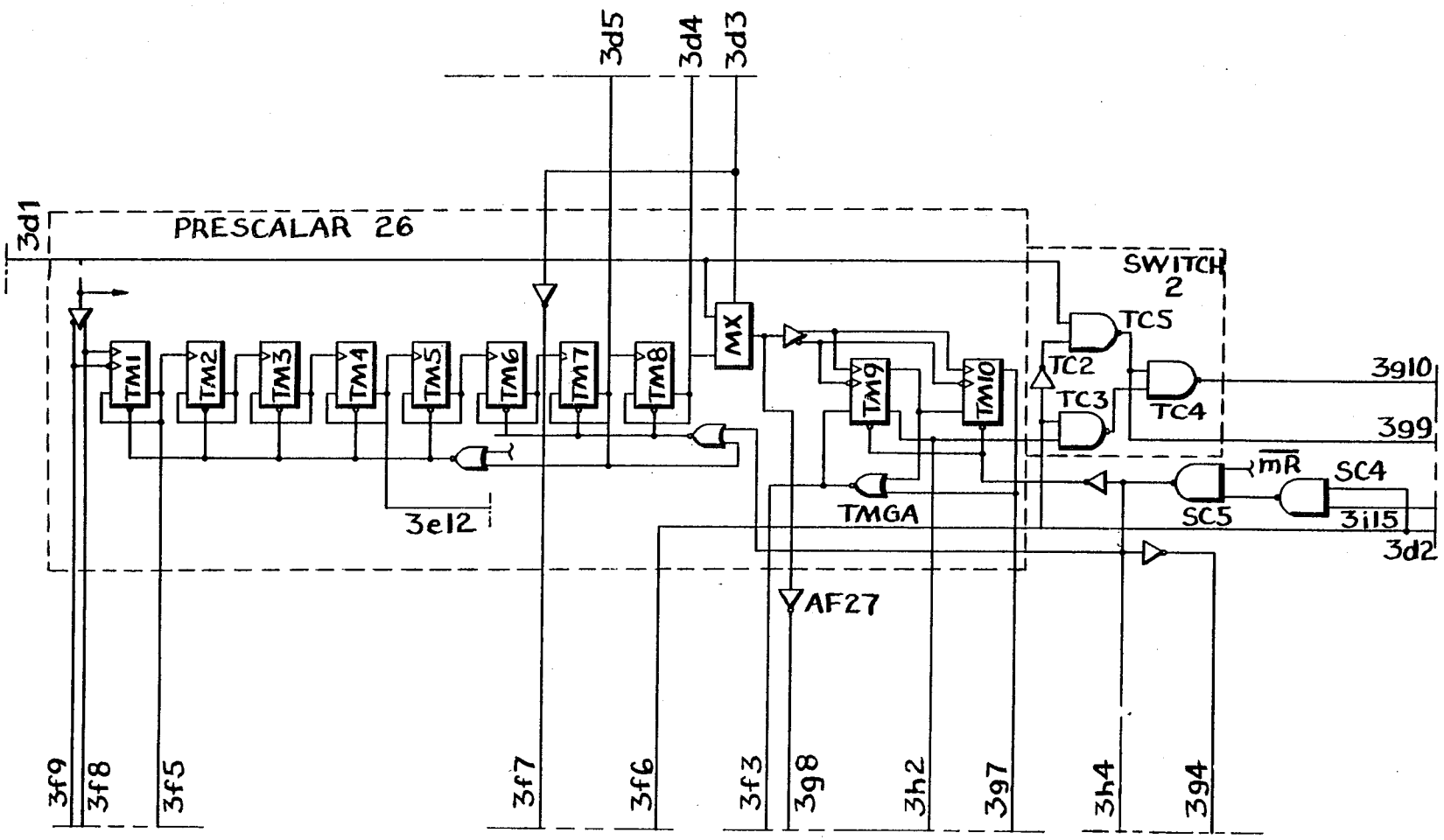
Figure 3E:
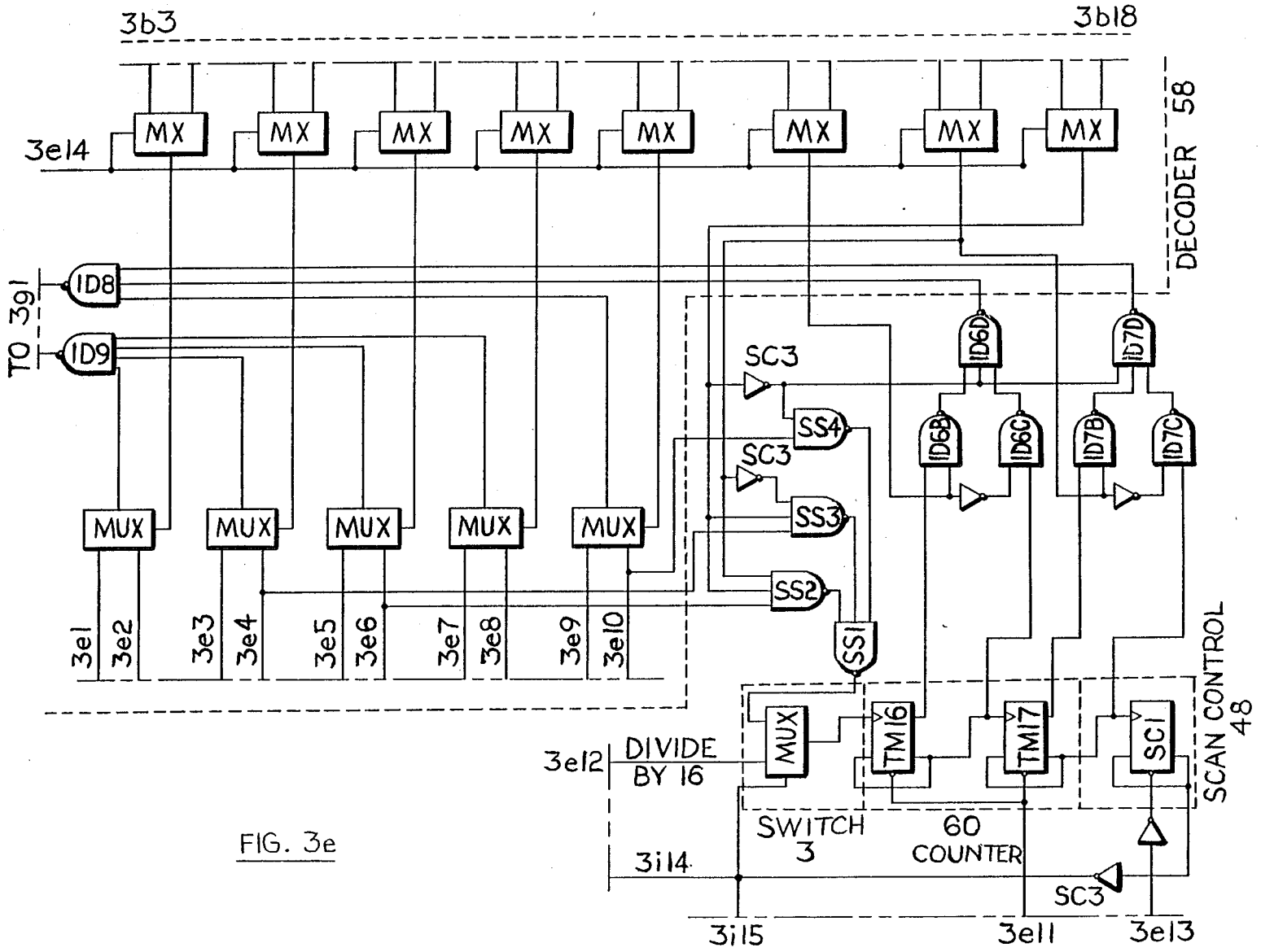
Figure 3F:
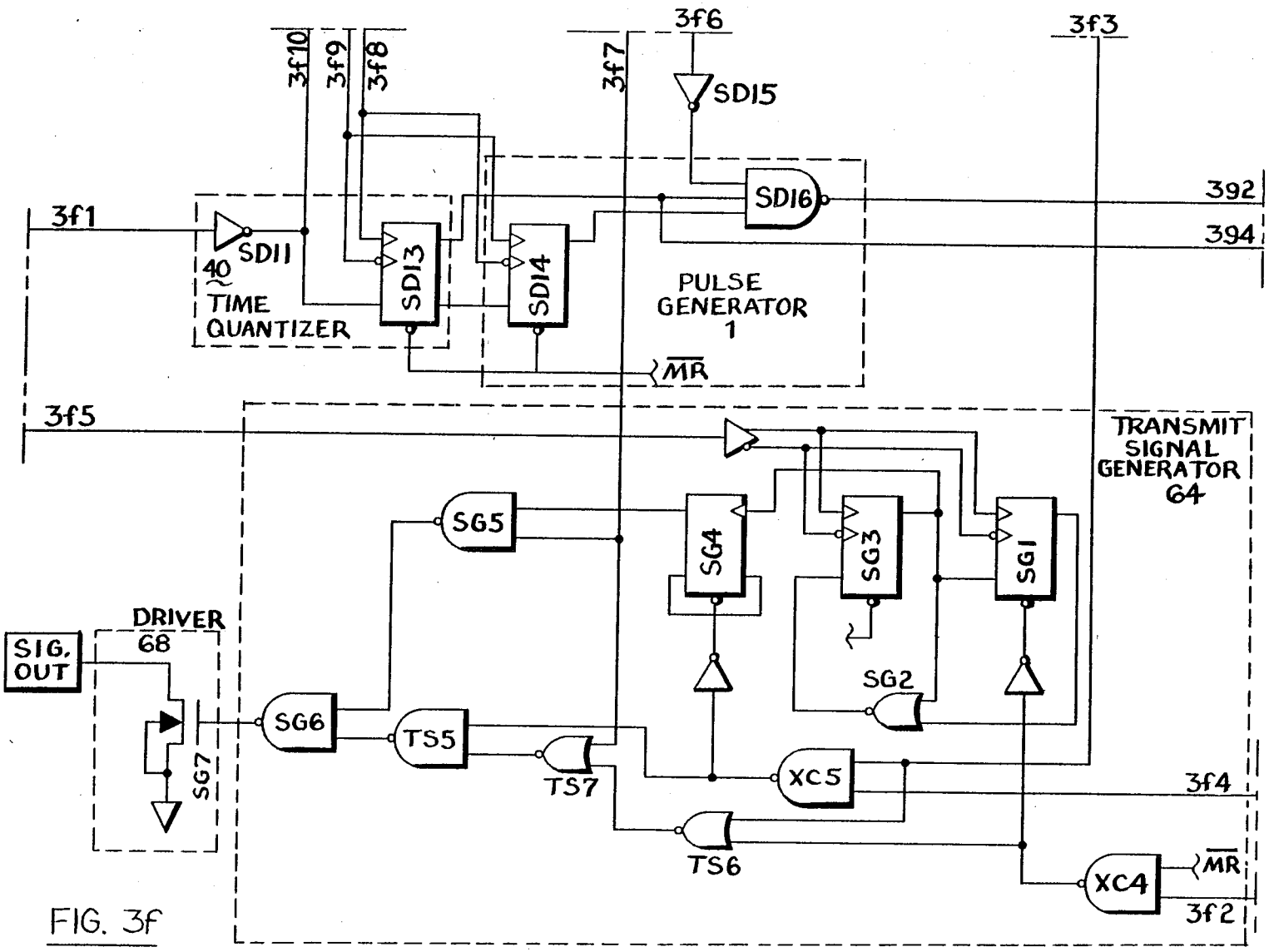
Figure 3G:
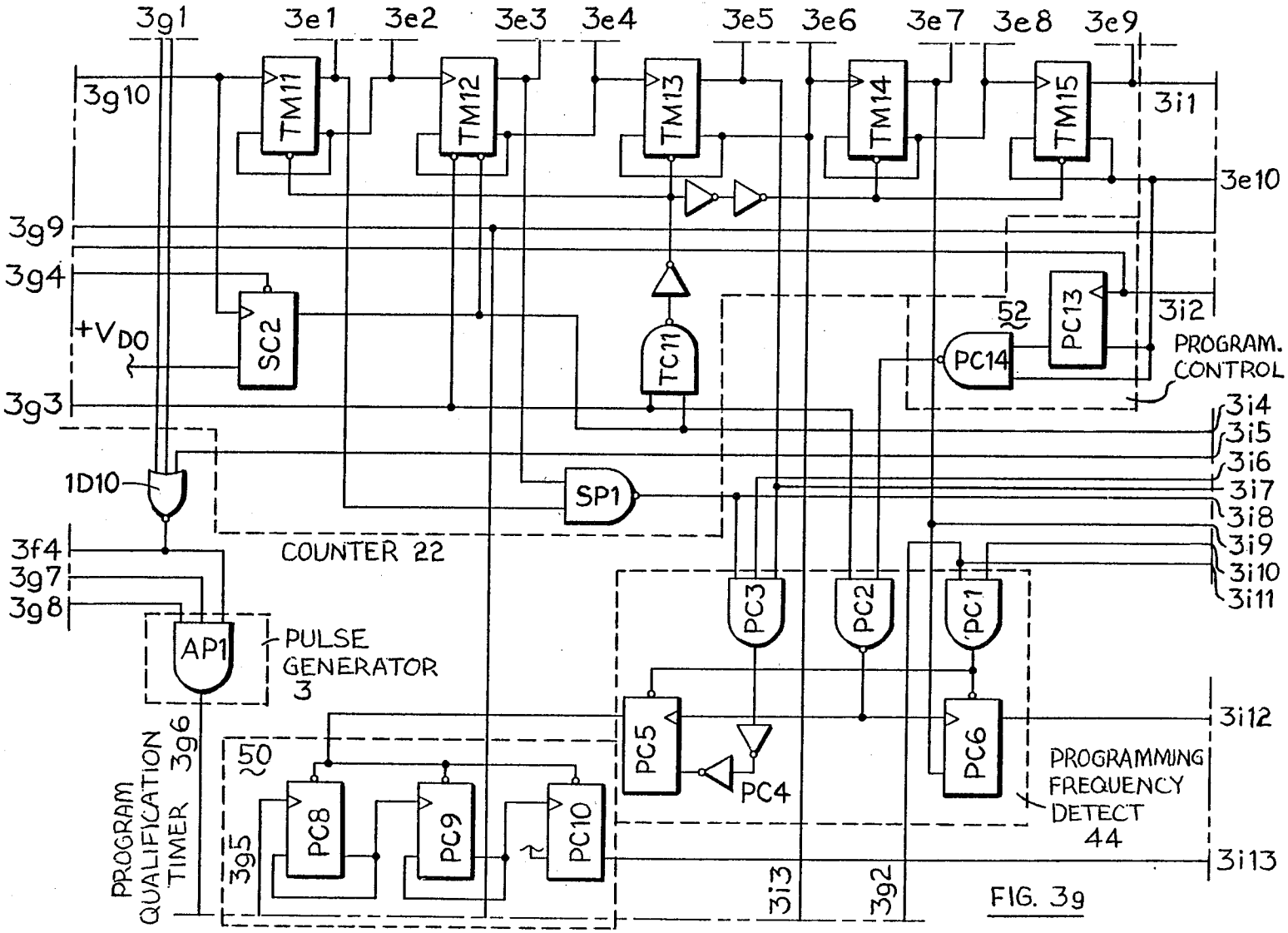
Figure 3H:
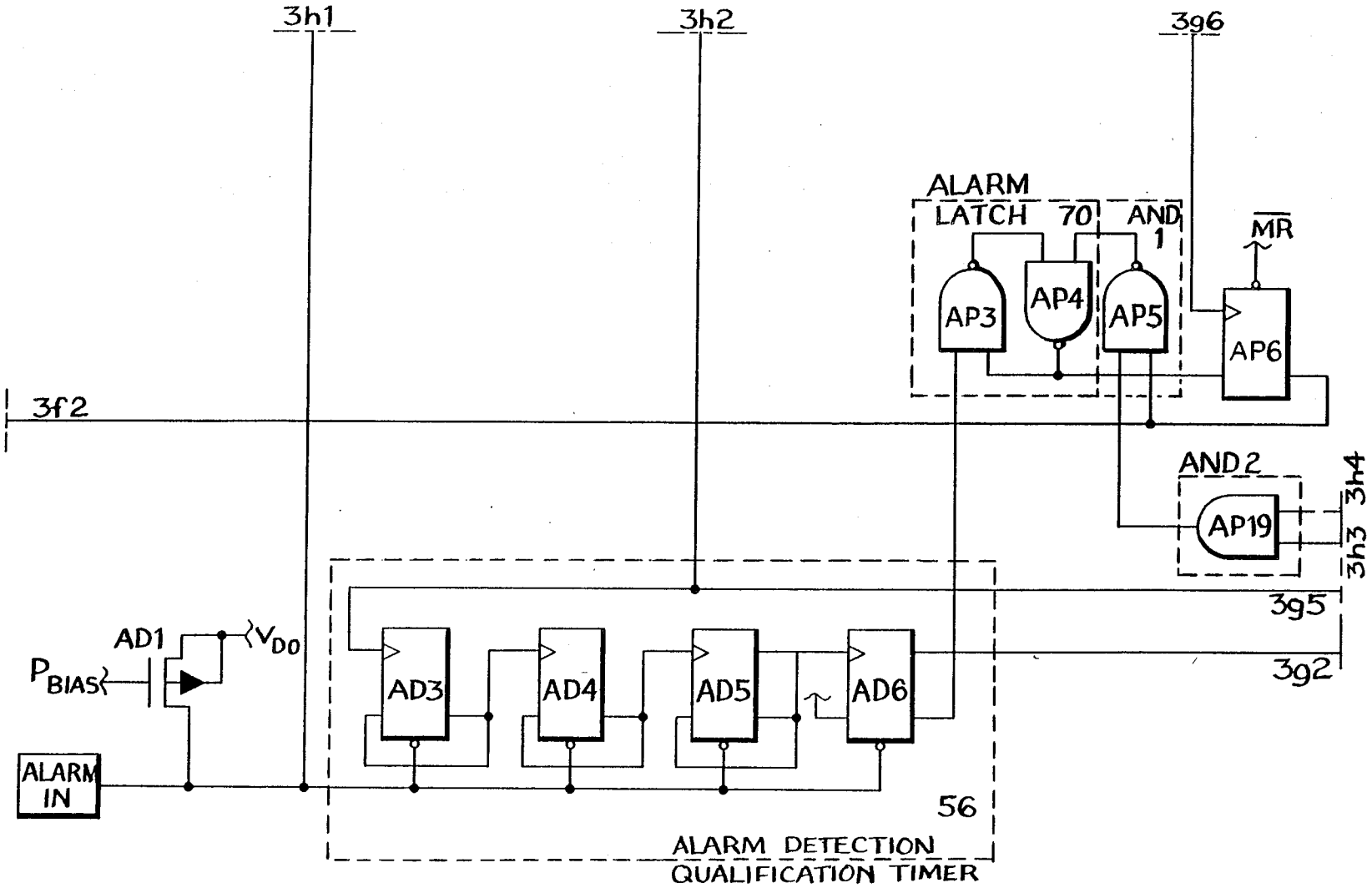
Figure 3I:
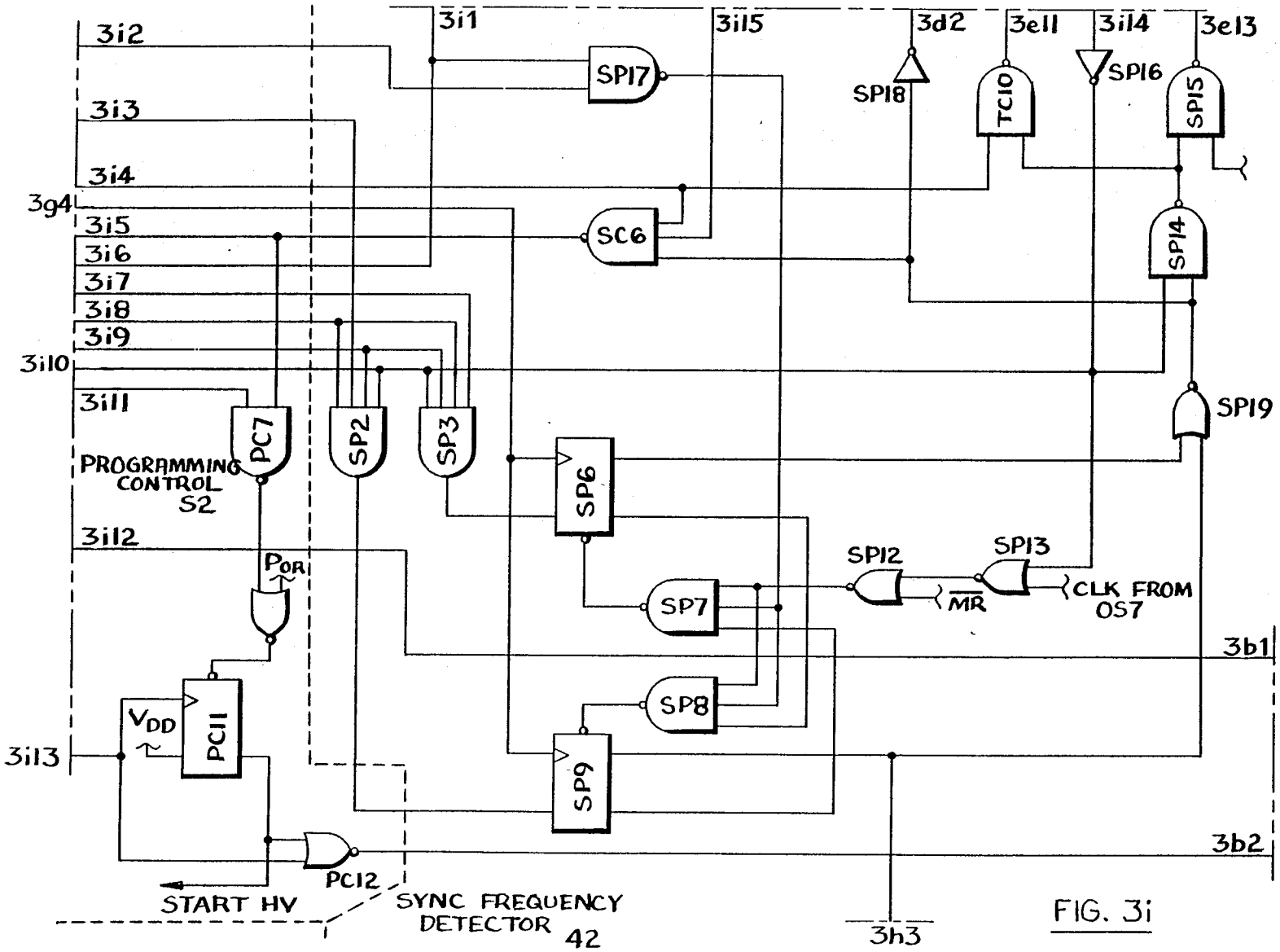

Turning attention next to FIGS. 2*a* and 2*b*, a generalized block diagram is shown of the particular circuitry which is included in the integrated circuit 20. FIGS. 3 and 3*a* to 3*i*, in turn, depict a detailed schematic diagram of the circuitry of FIGS. 2*a* and 2*b*. The following description is however principally directed to the block diagram arrangement of FIG. 2. Parenthetical reference is made from time-to-time to the corresponding detailed circuitry of FIG. 3. To the extent one skilled in the art might require detailed information to the implementation of each block, attention is therefore directed to FIGS. 3 and 3*a* to 3*i*.

Before discussing the operation of the circuitry in detail, it is to be appreciated that in order to achieve the packaging requirements mentioned above, portions of the circuitry are switched to permit alternative modes of the operation. Accordingly internal switches SW2 and SW3 are provided. Although shown in analog form, they are physically constructed of digital logic elements which operate in a corresponding fashion to the switches shown.

Of the two alternative switch positions A and B, the A position corresponds to the operation of the circuit 20 in a status response mode wherein a synchronization signal has been received from the system controller 4 and the counter 22 is operating in a "response interval counter" mode. The counter 22 then counts clock pulses relative to the programmed response interval until it reaches a count corresponding to the start time of the interval wherein the circuit 20 is programmed to respond to the controller 4. It also maintains track of the system reporting interval and after which it is reset.

Alternatively in the B or default position, the counter 22 operates to time the period of a received signal to determine whether it is a programming signal or whether it is a synchronizing signal. That is, the controller 4 is operative to transmit alternative binary signals for synchronizing the response of the circuitry 20 with the system's 2 other time multiplexed transponders 1 and for programming the identity or wait period before a transponder 1 transmits its alarm status condition. In particular, either a logic high frequency FH of 4096 Hz or a logic low frequency FL of 2731 Hz is applied by the controller 4 to induce each transponder's 1 synchronization. The FH and FL frequencies are also used by each transponder 1 to determine whether it is to retransmit its alarm status condition in a successive reporting period. Otherwise, a logic high programming frequency FHp of 1638 Hz and a logic low frequency FLp of 1170 Hz are appropriately applied by the controller 4 to program the circuit 20 with its peculiar identity. The identity again defines a predetermined delay before the response interval is initiated for each intelligent contact 1.

Referring therefore to the circuitry of FIG. 2, its operation will be described to its various modes of operation which are as follows.

SYNCHRONIZING/PROGRAMMING CONFIRMATION

Prior to the occurrence of a switch action at the switches SW2 and SW3, they are each in their default or B position and wherein received signals are monitored to determine their frequency via the counter 22. That is, with the receipt of an input signal on conductor 36 from the controller 4 and with the switches SW2 and SW3 in their default or B positions, the received signal is first amplitude quantized by the Schmitt trigger 38. It is then coupled to the time quantizer 40 which synchronizes the received signal with the clock output of the oscillator 24. With the next cycle of the input signal, the time quantizer 40 couples the amplitude and time quantized input signal to the pulse generator 1 and simultaneously to the sync and programming frequency detector circuits 42 and 44.

Meanwhile, clock pulses from the oscillator 24, which is driven via a 32.768 KHz crystal K1 are coupled directly by switch SW2 to the counter 22, where they are counted. Alternatively, for an A switch position, the counter 22 counts the output of the prescaler circuitry 26.

The prescaler circuitry 26 essentially divides down the oscillator output by various factors to produce variously desired clock signals. A divide factor of 768 produces an approximate twenty-five millisecond clock signal which is counted at the counter 22. The prescaler 26 is also operable to appropriately divide the oscillator output by a factor of 2, 3 or 16. A divide by 2 output is used during alarm transmissions, while a divide by 3 output is used during a high speed test operation, but which normally occurs only during chip manufacture.

During frequency confirmation, however, only the divide by 16 or fosc/16 output is coupled via the B position of switch SW3 to a two bit counter 60. This output is decoupled from the circuitry 20 when SW3 is in its A position. If a programming frequency is received, the programming circuitry is enabled. If an intermittent programming signal is received, the counter 60 periodically resets itself. If a sync signal is received, the scan control circuitry 48 is enabled and a scan operation is begun, which is described in detail in the Scan Start portion of the description.

In any case, with the beginning of each cycle of the received input signal, which can correspond to a signal at a frequency of any of 1170, 1638, or 2731, 4096 Hz, the pulse generator 1 produces an oscillator synchronized reset signal to the counter 22. The counter 22 then counts at the unscaled oscillator rate, until the next cycle of the input signal when the pulse generator 1 again resets the counter 22. The accumulated count value of the counter 22 is next coupled via the bus 46 to each of the sync and programming frequency detector circuits 42 and 44 which logically determine the frequency of the received input signal. Depending upon the detected frequency, one or the other of the detectors 42 and 44 is enabled. If a FH or FL sync signal is detected, a start of scan pulse is produced via the counter 60 and the scan control circuitry 48, which is also reset by the sync detector 42.

PROGRAMMING

Assuming that the received signal from the controller 4 is determined to be either 1170 or 1638 Hz, the programming detection circuitry 44 enables the programming signal qualification timer circuitry 50. The qualification timer 50 counts at the prescaled clock rate of fosc/768 to monitor the frequency of the FHp and FLp input signals and produce corresponding data signals. The data output of the qualification timer 50 is coupled to the shift register 30. The programming control circuitry 52, in turn, responsively produces memory 28 control signals and a clock signal which clocks the shift register 30.

As the received data is clocked into the shift register 30, it is shifted through the eight register stages. Once all the register stages are loaded, the programming control logically produces a read signal which causes the shift register contents to be read into the non-volatile, EEPROM memory 28. If power is subsequently lost, such as with the severing of the conductor 36 and from which circuit power is derived, the programming control circuitry 52 induces a write signal which causes the data stored in memory 28 to be written into shift register 30. Alternatively, an erase signal might be coupled from the programming control 52 such as at the factory, to erase the memory 28 contents during test.

Of the eight bits included in the shift register 30 and memory 28, the most significant bit position, shown at blocks 32 and 34, is used to select an abbreviated or "short scan cycle" for systems having relatively few alarm contacts. The details of a short scan cycle are described below relative to the Scan Start sequence of events.

In passing, it is also to be appreciated that the programming control 52 via a signal on conductor 54 from the alarm detection qualifying timer 56 is enabled only when the magnetic alarm contact SW1 is in an open position. This condition typically occurs during system installation, prior to closing the contact and when all other previously mounted transponders 1 are in their closed positions.

If, too, the controller 4 had earlier initiated an alarm scan routine which was in effect at the time of receipt of a programming signal, the scan control circuitry 48 produces a disable signal to disable the programming control 52. This disable signal continues throughout the scan cycle and thus programming cannot occur during a previously initiated alarm cycle.

WAITING FOR SYNC

If the input signal is received at a frequency of 2731 or 4096 Hz, the counter 22 produces an output which, instead of enabling the programming frequency detection circuit 44, enables the sync frequency detection circuitry 42. That is, the sync detection circuitry 42 includes logic circuitry which distinguishes the output of the counter 22 and the FL and FH frequencies from the FLP and FHP frequencies. With the detection of either of the former frequencies, a reset signal is coupled to the scan control circuitry 48.

Simultaneous with the operation of the counter 22, while the switch SW3 is in its B position, the mentioned two-bit counter 60 operates as a sync signal qualification timer. It counts the prescaler's fosc/16 signals on conductor 62. Once the counter 60 reaches its maximum count, a control signal is produced which induces the scan control circuit 48 to produce an output and switch the switches SW2 and SW3 to their A positions. Thereafter, the two-bits of counter 60 are serially coupled to the five-bits of counter 22 which combined "response interval" counter operates to maintain a running count of the fosc/768 signals produced by prescaler 26 relative to the programmed response or delay interval and the system reporting interval.

With the setting of the switches SW2 and SW3 and assuming receipt of an FH sync signal, the scan control circuit also induces pulse generator 2 to reset prescaler 26 and couple a logic high to AND gate 2. Because a sync frequency detect occurred, the sync detector circuit 42 also couples a logic high to AND gate 2 which, in turn, couples a logic high to AND gate 1. AND gate 1 is thus armed and in a position to control the frequency at which the alarm status is transmitted. The operation of the alarm and transmit circuitry will follow below.

SCAN START

With the coupling of the two bits of counter 60 to the five bits of counter 22 and the resetting of the prescaler 26, a scan cycle begins and during which each circuit 20 initiates a scan count cycle dependent upon the number of transponders 1 coupled to the system 2. Once a value is achieved corresponding to the programmed response interval, the identity interval decoder 58 produces an enable transmission signal. That is, when the decoder 58 upon comparing the count value of the combined counters 22 and 60 with the preprogrammed contents of the shift register 30 finds correspondence, an enable signal is produced.

With the enabling of the transmit signal generator 64, the alarm status data on conductor 66 induces the transmit generator 64 to transmit at a frequency FH or FL corresponding to the logic condition of the magnetic contact SW1. The alarm frequency is derived from the base frequency of fosc/2 coupled from prescaler 26. The developed frequency at the signal generator 64 is, in turn, coupled to the driver 68 and via the signal output terminal of the circuit 20 to the transistor driver Q1 and thence to the data input terminal at the Pinpoint interface circuitry. If no tonal response is detected by the controller during the response interval, this condition is interpreted as a trouble condition.

For the presently preferred embodiment, during any given three second scan period, the seven identity bits permit up to 128 transponders 1 to respond. Where however less alarm inputs are available, the circuitry also provides for a selectable, reduced scan interval. That is, a short scan cycle may be enabled which provides for 16 or 32 time multiplexed intervals, instead of 128. An abbreviated scan cycle is particularly enabled via the setting or not of the seventh bit of the shift register 30 the short scan control latch 34 and the eighth stage 32 of non-volatile memory 28. The duration of the shortened scan cycle will depend upon the scaled clock frequency and the selected number of reporting intervals.

ALARM DETECTION/REPORTING

An alarm condition occurs upon the opening of the contacts of the switch SW1. This condition must be maintained for a period of time sufficient for the alarm detection qualifying timer 56 to reach its maximum count. If the switch opens and closes before a maximum count is reached, the reclosing of the contacts induces a resetting of the timer 56. Thus, the timer 56 acts as a digital filter to sensed alarms at the alarm input to qualifier 56.

If the timer 56 times out, a "set" control signal is produced which sets the alarm storage latch 70. With the concurrence of a transmit enable, when the count of the response interval counter 22 corresponds to the preprogrammed identity interval at decoder 58, pulse generator 3 clocks the contents of the latch 70 into the alarm reporting flip-flop 72. This value then determines the frequency of the signal transmitted from the signal generator 64 to the Pinpoint interface.

With the receipt of the next sync signal and assuming it is a "reset" signal at the FH frequency, as before, AND gate 2 produces a logic high which in combination with the alarm state of the flip-flop 72 induces AND gate 1 to reset alarm storage latch 70. Upon the occurrence of the next transmit enable signal, pulse generator 3 induces alarm flip-flop 72 to be loaded with the non-alarm or logic low state of latch 70 and causes the transmit signal generator 64 to transmit its FH frequency to indicate a non-alarm response. If the switch SW1 had not been reset, an alarm transmission at FL occurs.

Otherwise and in the alternative, if a sync signal at the FL frequency is received from the controller 4 (i.e. a non-reset sync), AND gate 2 blocks the resetting of latch 70. The alarm flip-flop 72 thereby retains its alarm state and induces a second alarm transmission. Although a second alarm transmission occurs during a non-reset sync scan, it is to be appreciated that the alarm can be due to the non-resetting of the switch SW1. In any case, however, an alarm, even if momentary, never goes unreported.

Appreciating also that a momentary alarm can occur any time during a scan sequence, before or after the alarm reporting interval, if it occurs after, the alarm storage latch captures and retains the alarm state until the next scan interval. At that time, because the alarm flip-flop 72 is in a non-alarm state from the previous transmission, AND gate 1 is blocked and latch 70 is not reset. During the next alarm reporting interval, however, the flip flop 72 is clocked as before and the alarm is reported. All alarms are thus reported, regardless of their time of occurrence relative to the reporting interval, so long as they meet the requirements of qualification timer 56.

HIGH SPEED TESTING

Also included with the present circuitry is a high speed test function wherein a logic low input at the control input of the circuit 20 can induce a master reset operation. Typically this occurs during manufacture and inspection with the resetting of all the sections of the circuit 20. At that time prescaler 26 is also enabled to a divide by 3 condition, instead of dividing by 768, and whereby the test functions can be performed at an accelerated rate with all tests starting from a known state. Additionally, it is to be appreciated that as with programming the circuitry 20, the test function requires that switch SW1 be in its open position to permit timer 56 to produce an enable reset signal. Otherwise, once switch SW1 is closed, the master reset timer is disabled.

While the present invention has been described with respect to its presently preferred embodiment and its typical operation and construction, it is to be appreciated that still other configurations may be conceived by those with skill in the art without departing from the spirit and scope of the invention. Accordingly, it is contemplated that the following claims should be interpreted to include all those equivalent embodiments within the scope thereof.

What is claimed is:

1. In a time multiplexed hardwired alarm system having a local controller monitoring each of a plurality of distributed alarm points, apparatus for identifying the alarm status of each alarm point during an assigned response interval within a system reporting interval comprising:

(a) a magnetic switch;

(b) transceiver means hardwired to said controller for receiving programming signals defining a reporting interval of said switch and synchronizing signals initiating and defining the number of times the alarm status of said switch is to be reported to said local controller, said transceiver means comprising;

(i) means for quantifying the amplitude of received signals, (ii) a crystal oscillator, (iii) means for synchronizing the quantified signals with said crystal oscillator, (iv) means responsive to the received signals for distinguishing a binary pair of programming frequencies from a binary pair of synchronizing frequencies, (v) means responsive to received signals at said programming frequencies for writing a start of response time into a shift register and a nonvolatile memory, (vi) means for enabling a counter upon receipt of one of said pair of synchronizing frequencies and producing a transmit control signal upon concurrence of an accumulated count with said start of response time, and (vii) means for transmitting one of a pair of binary frequencies corresponding to switch status upon receipt of said transmit control signal; and (c) wherein said switch and said transceiver means are included in a single package mountable in obscured relation to a monitored alarm point.

2. Apparatus as set forth in claim 1 including means for transmitting the alarm status of said switch once upon receipt of one of said pair of synchronizing frequencies and for re-transmitting the detected alarm status each reporting interval thereafter so long as the other of said pair of synchronizing frequencies is received each following response interval.

3. Apparatus as set forth in claim 1 including means for selectively varying the start of the response time

4. Apparatus as set forth in claim 1 including means for enabling the programming of said transceiver means only when said switch contact in one of a plurality of switch positions.

5. Apparatus as set forth in claim 1 wherein said counter comprises first and second counter portions and includes means for serially coupling said first and second counter portions to one another upon receipt of either of said pair of synchronizing signals.

6. In a time multiplexed hardwired alarm system having a local controller monitoring each of a plurality of distributed alarm points, apparatus for identifying the alarm status of each alarm point during an assigned response interval within a system reporting interval comprising:

(a) a magnetic switch;

(b) transceiver means hardwired to said controller for receiving programming signals defining a reporting interval of said switch and synchronizing signals initiating and defining the number of times the alarm status of said switch is to be reported to said local controller, said transceiver means comprising;

(i) a clock source, (ii) means for synchronizing received programming and synchronizing signals with said clock source, (iii) means responsive to the received signals for distinguishing a binary pair of programming frequencies from a binary pair of synchronizing frequencies, (iv) means responsive to received signals at said programming frequencies for writing a start of response time into a shift register and a nonvolatile memory, (v) means for enabling a counter upon receipt of one of said pair of synchronizing frequencies and producing a transmit control signal upon concurrence of an accumulated count with said start of response time, and (vi) means for transmitting one of a pair of binary frequencies corresponding to switch status upon receipt of said transmit control signal; and (c) wherein said switch and said transceiver means are included in a single package mountable in obscured relation to a monitored alarm point.

7. In a time multiplexed hardwired alarm system having a local controller monitoring each of a plurality of distributed alarm points, apparatus for identifying the alarm status of each alarm point during an assigned response interval within a system reporting interval comprising:

(a) means for monitoring a physical condition for an alarm condition; and (b) transceiver means hardwired to said controller including a nonvolatile, eraseable memory for receiving a first binary pair of frequencies and programming a unique alarm reporting interval within the system interval different from the other alarm points into said memory and for receiving a predetermined one of a second binary pair of frequencies different from said first pair and redundantly reporting the alarm status of said switch each successive system reporting intervals initiated thereafter by the predetermined one of said second pair of frequencies.

8. Apparatus as set forth in claim 7 including transmitter means for reporting alarm status as a third pair of binary frequencies and a trouble condition as no transceiver response during the response interval.

9. In a time multiplexed hardwired alarm system having a local controller monitoring each of a plurality of distributed alarm points, apparatus for identifying the alarm status of each alarm point during an assigned response interval within a system reporting interval comprising:

(a) bistate means for distinguishing an alarm from a non-alarm condition;

(b) transceiver means hardwired to said controller including a nonvolatile, eraseable memory for receiving a first binary pair of frequencies and programming a unique alarm reporting interval within the system interval and different from the other alarm points into said memory and for initiating the reporting of the alarm status of said bistate means at least once during successive system reporting intervals upon receipt of either of a second binary pair of frequencies different from said first pair and further including;

(i) clock means for producing a plurality of clock signals at different frequencies;

(ii) switch means coupled to said clock means and having at least first and second switch positions, and (iii) means coupled to said switch means for counting clock signals of respective first and second frequencies when said switch means is in said respective first and second switch positions, (iv) means for comparing the accumulated count of said counter means to distinguish the received signal relative to said first and second pairs of binary frequencies at said first switch position and to detect a predetermined relation to said programmed reporting interval at said second switch position.

10. Apparatus as set forth in claim 9 including means coupled to said counter means and said memory for selectively defining the duration of said system reporting interval.

11. Apparatus as set forth in claim 9 including means for transmitting a third binary pair of frequencies corresponding to the alarm status of said bistate means and not transmitting during any programmed response interval upon detecting a trouble condition.

* * * * *